United States Patent [19]

Moskaliuk et al.

[11] Patent Number: 4,920,707

[45] Date of Patent: May 1, 1990

[54] INTERIOR CANOPY FOR STADIUM

[76] Inventors: Wiktor Moskaliuk, 270 Lisgar St., Toronto, Ontario, Canada, M6J 3G7; Christopher M. Allen, 18 Birchview Rd., Ottawa, Ontario, Canada, K2G 3G4; Roderick G. Robbie, 16 Cornish Rd., Toronto, Ontario, Canada, M4T 2E2

[21] Appl. No.: 255,032

[22] Filed: Oct. 7, 1988

[51] Int. Cl.[5] ..... E04B 7/16

[52] U.S. Cl. ..... 52/6; 52/83

[58] Field of Search ..... 52/6, 74, 80, 83, 123.1, 52/126.7, 63; 272/21, 24, 25

[56] References Cited

U.S. PATENT DOCUMENTS

| | | | |
|---|---|---|---|
| 2,415,202 | 2/1947 | Ferguson | 52/83 |
| 2,517,003 | 8/1950 | Leve | 274/21 |
| 3,510,996 | 5/1970 | Popil | 52/6 |
| 3,922,822 | 12/1975 | Mollinger | 52/63 |
| 3,965,625 | 6/1976 | White | 52/29 |
| 4,494,707 | 1/1985 | Niibori et al. | 52/169.7 |
| 4,676,033 | 6/1987 | Allen et al. | 52/6 |

FOREIGN PATENT DOCUMENTS

| | | | |
|---|---|---|---|
| 28356 | 2/1925 | France | 272/24 |
| 379821 | 9/1932 | United Kingdom | 52/83 |

*Primary Examiner*—David A. Scherbel
*Assistant Examiner*—Michele A. Van Patten
*Attorney, Agent, or Firm*—Smart & Biggar

[57] ABSTRACT

To form an audience chamber in a roofed stadium, at least one truss suspendable from the stadium roof and a canopy removably connectable to the truss. The canopy comprises a plurality of parallel, contiguous elongated panels of flexible material. A close-off curtain is suspendable from the canopy when only a portion of the stadium is to be used as the audience chamber.

17 Claims, 9 Drawing Sheets

INTERIOR CANOPY FOR STADIUM

FIELD OF THE INVENTION

This invention relates to an interior canopy for a roofed stadium, forming an audience chamber.

BACKGROUND OF THE INVENTION

Roofed stadia such as that shown in U.S. Pat. No. 4,676,033 issued June 30, 1987 to Roderick Robbie and Michael Allen are cavernous and suited to certain types of sports spectacles such as football and baseball. To adapt such stadia to spectacles suited to smaller audiences, such as boxing or tennis, and to spectacles requiring special acoustical conditions such as rock concerts and opera, would enhance the value of the structures by putting them to more frequent use.

It is well known to hang vertical baffles from the roof of a stadium or concert hall to enhance its acoustic properties. Such baffles, however, do not provide a closed environment and the cavernous aspect of the interior of the structure is not removed.

It is an object of the present invention to provide an audience chamber in a stadium by suspending a canopy from the roof of a stadium.

It is a further object of the invention to provide a suspended audience chamber canopy which may be erected and collapsed at will.

Another object of the invention is to provide a suspended audience chamber canopy which is modular for use of only a portion of the stadium.

STATEMENT OF THE INVENTION

Essentially the invention consists of adapting a roofed stadium as an audience chamber by means of at least one truss suspendible from the roof and a canopy of flexible material removably connectable to the truss. A close-off curtain is suspendable from the canopy when only a portion of the stadium is to be used as the audience chamber.

BRIEF DESCRIPTION OF DRAWINGS

Example embodiments of the invention are shown in the accompanying drawings in which.

DESCRIPTION OF PREFERRED EMBODIMENT

Figures 1, 2:
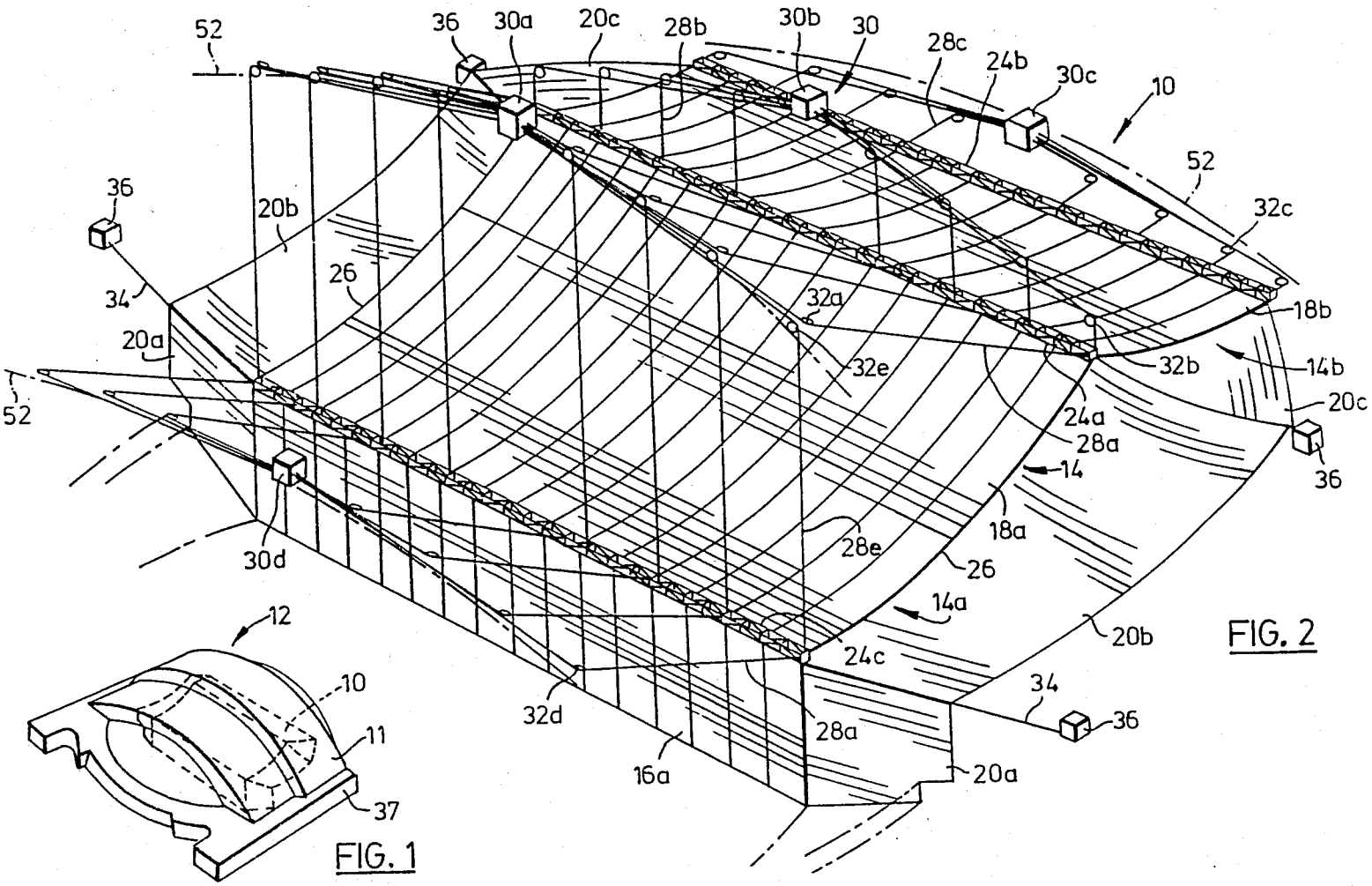
FIG. 1 is a schematic perspective view of a roofed stadium showing in dotted lines a canopy utilizing half the arena and its associated seating.
FIG. 2 is a schematic perspective view of the enclosure of FIG. 1.
Figure 3:
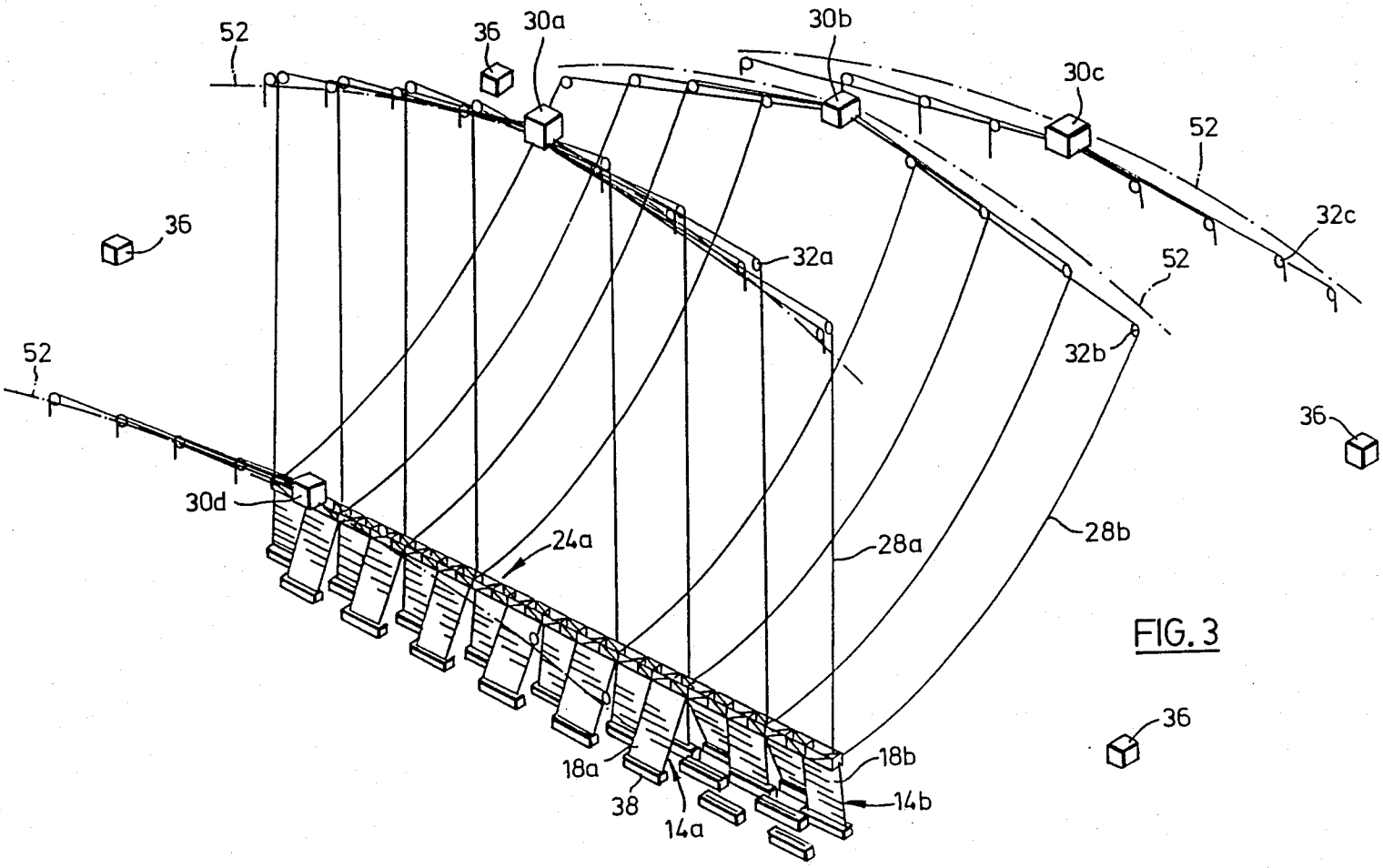
FIGS. 3 to 7 inclusive are perspective views of successive stages in the erection of the canopy of FIGS. 1 and 2.
Figure 4:
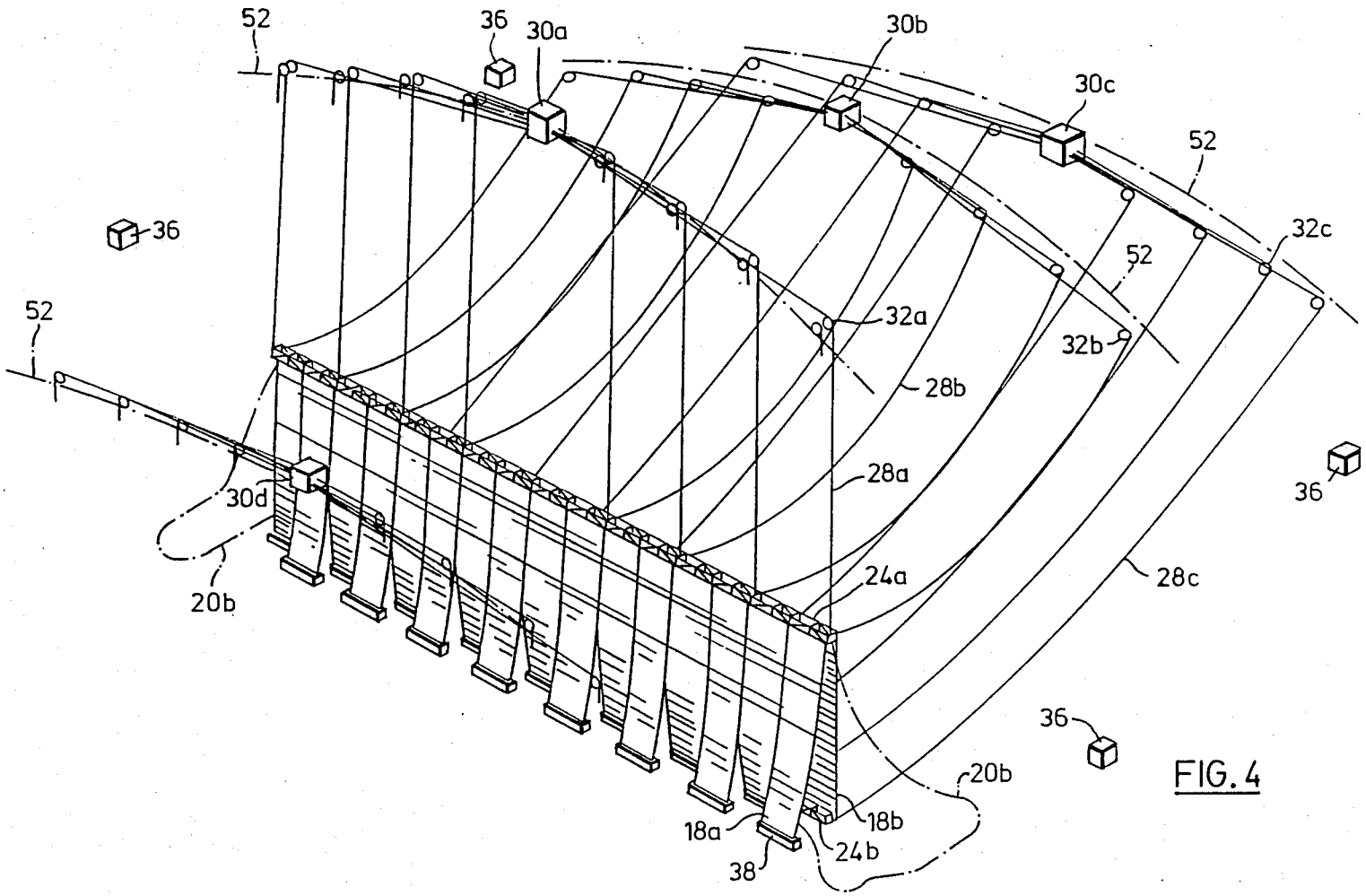
Figure 5:
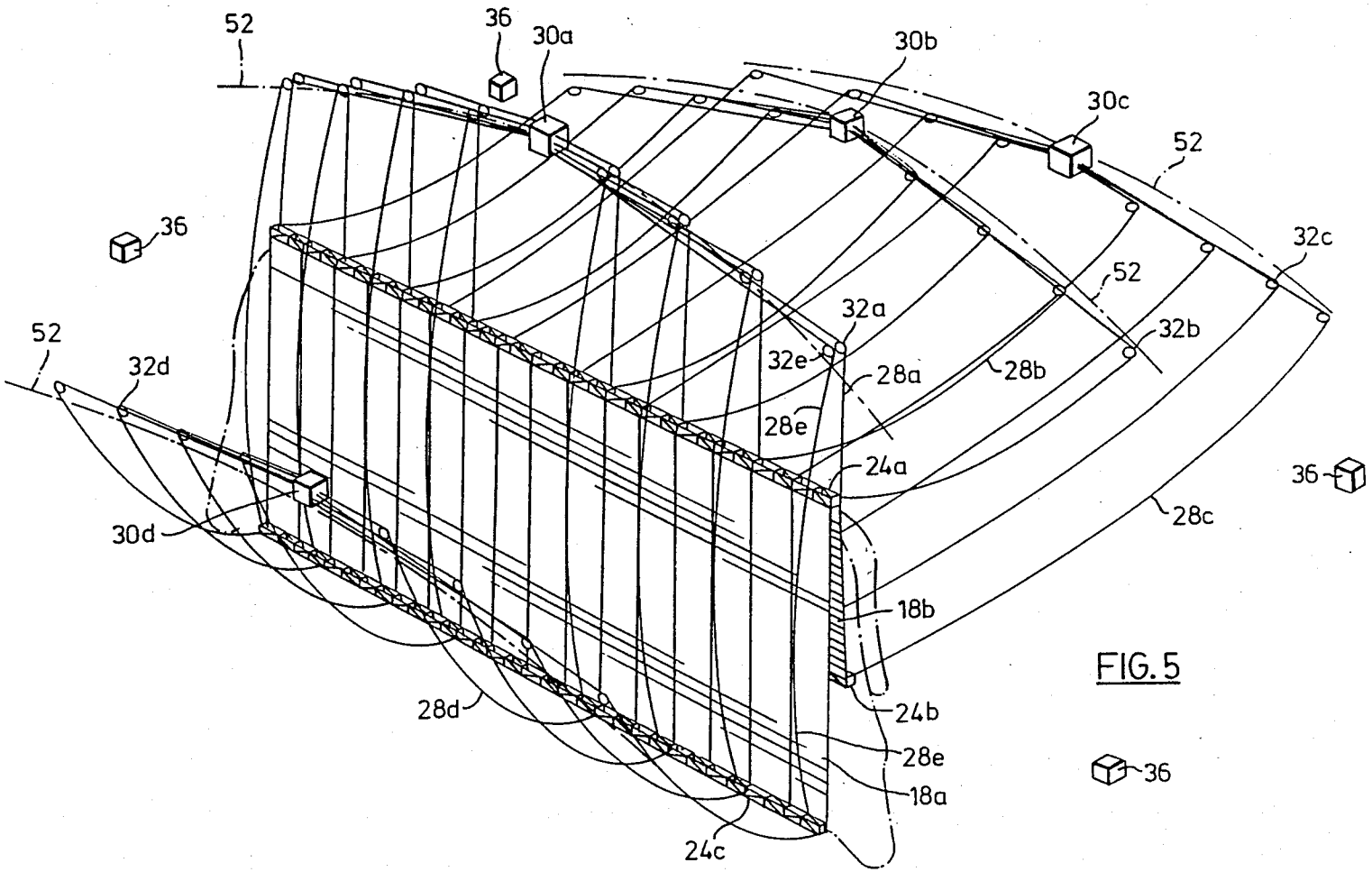
Figure 6:
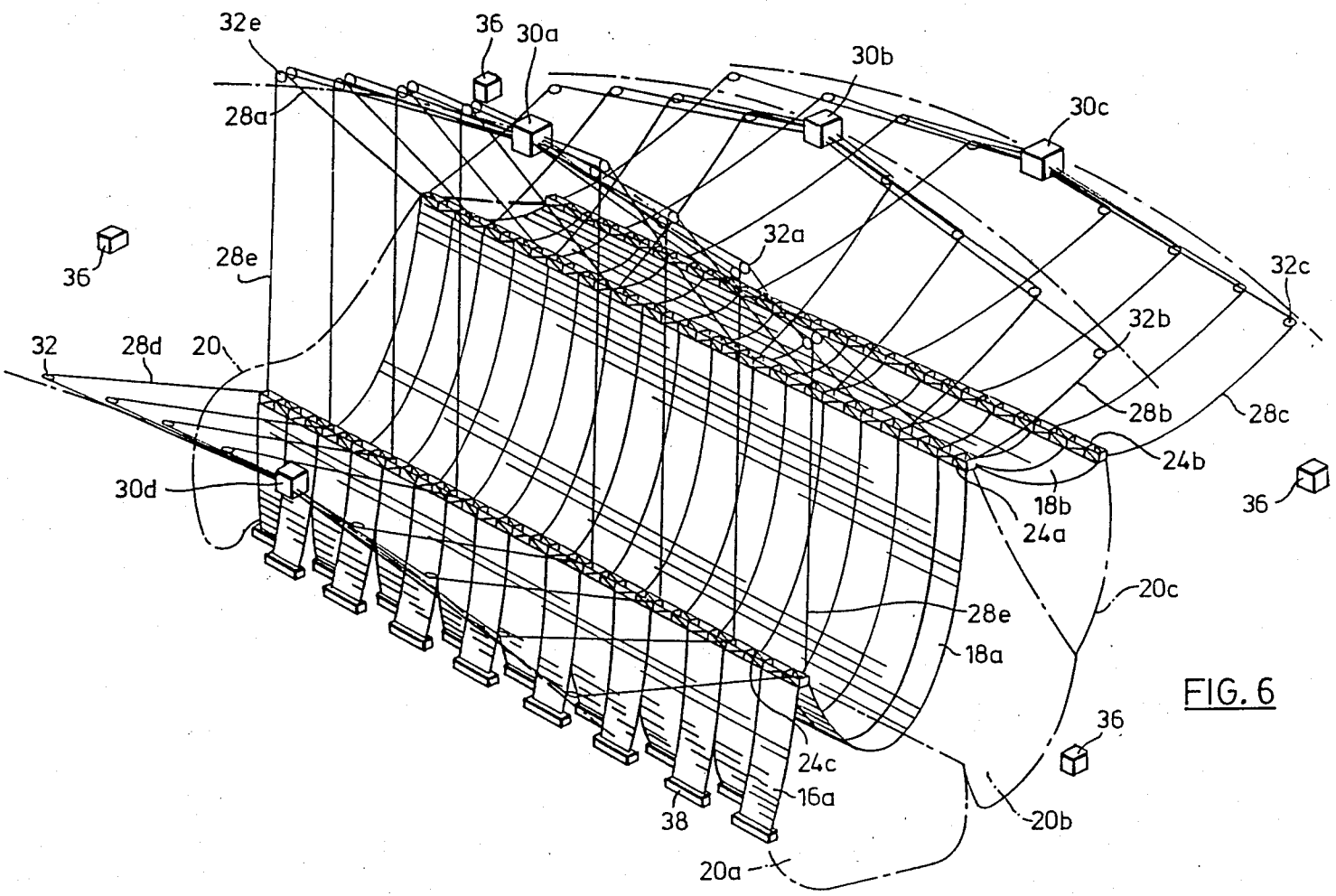
Figure 7:
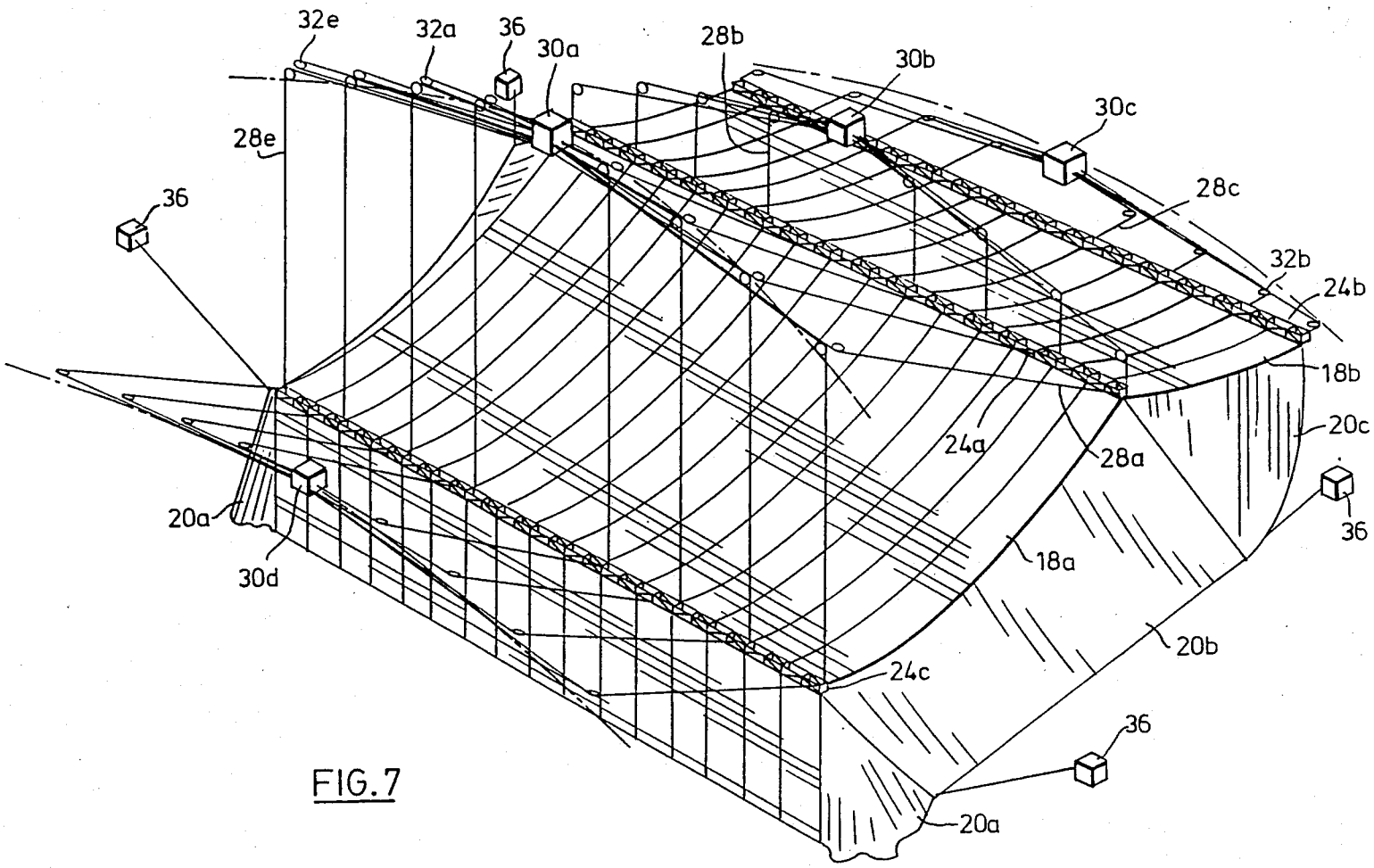

The example embodiment shown in the drawings consists of a canopy 10 suspended from the roof 11 of a closed stadium 12 of the type disclosed in aforementioned U.S. Pat. No. 4,676,033, as seen in FIG. 1.

FIG. 2 shows a canopy 14 and a close-off curtain 16 which is connected along one edge of the canopy. Canopy 14 comprises a plurality of parallel panels 18 each of which is attached by hooks 22 to one or more box trusses 24, as seen more particulary in FIG. 8. Close-off curtain 16 is comprised of further plurality of parallel panels 18 having a leading end 19. Side panels 20, formed of three single sheets 20*a*, 20*b* and 20*c* which are attached to the edges 26 of the outermost of panels 18 of the main canopy portion by hooks and eyes (not shown), form lateral extensions on each side of the canopy.

Panels 18 are attached to three rows of box trusses 24 each of which is suspended by a plurality of cables 28 from a series of winch stations 30 through rows of sheaves 32. Side panels 20 are held in an extended position by further cables 34 from further winch stations 36. Winch stations 30 are mounted on the roof structure of stadium 12 and winch stations 36 are mounted on walls 37 of the stadium.

Figure 8:
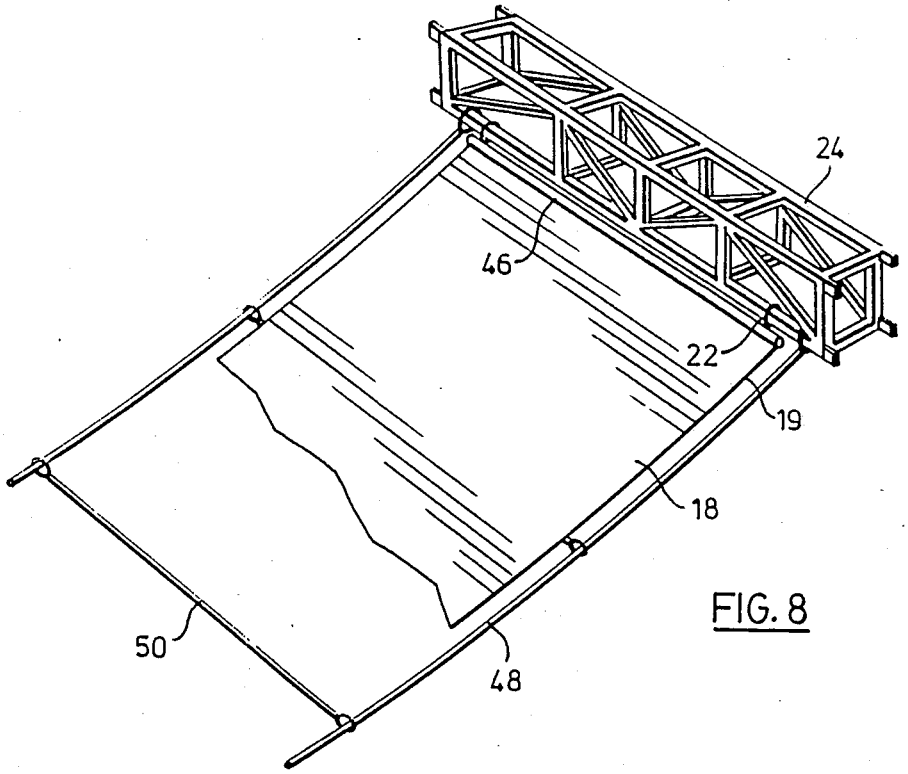
FIG. 8 is a perspective view of a box to which one panel of the canopy is attached.
Figure 9:
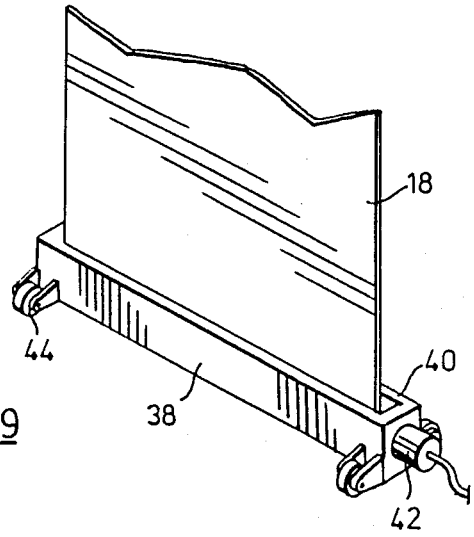
FIG. 9 is a perspective view of a container holding one panel of the canopy.
Figure 10:
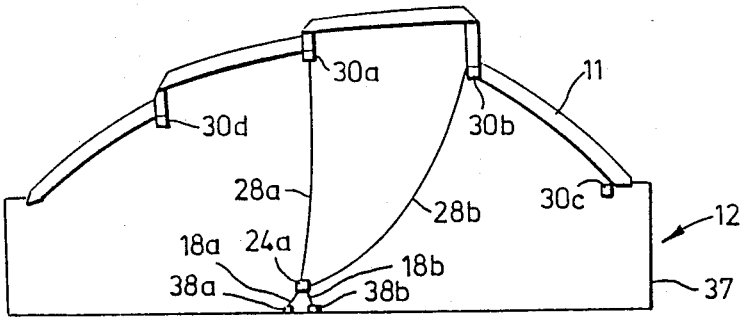
FIGS. 10 to 14 inclusive are side elevational views of the stadium of FIG. 1 showing schematically the successive stages in the erection of the canopy shown in FIGS. 3 to 7.
Figure 11:
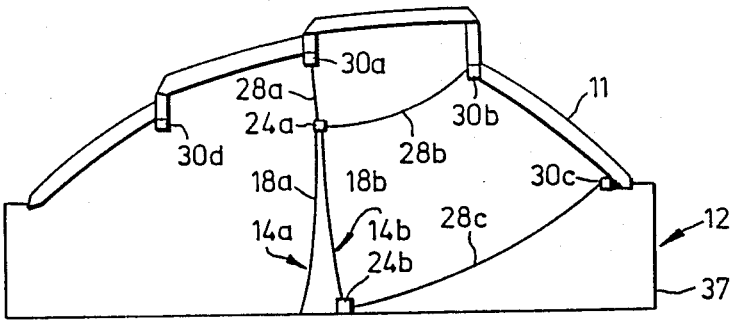
Figure 12:
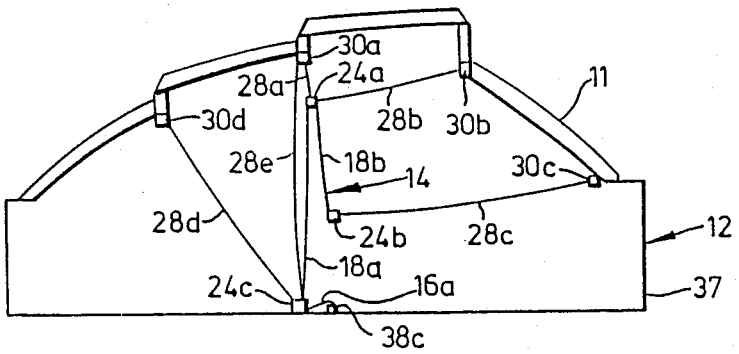
Figure 13:
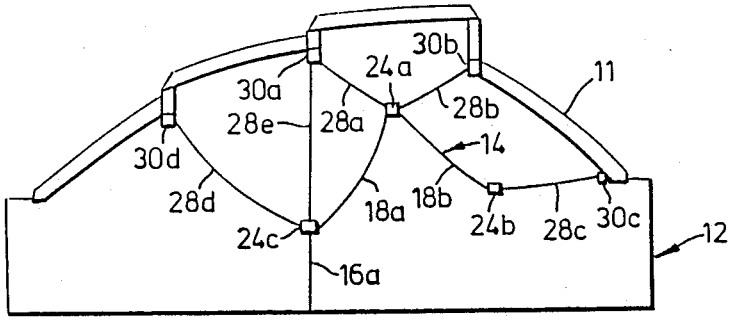

Each panel 18 is housed, when not in use, in a roll within a container 38 having a slot 40 from which the panel may be unrolled, using an auxiliary electric motor 42, if desired, as seen in FIG. 9. Each container is movable on castors 44. As seen in FIG. 8, leading end 19 of each panel carries a transverse stiffening rod 46. Rows of parallel safety cables 48 are hooked at each end to box trusses 24 and transverse with interconnecting cables 50 at spaced intervals to support panels 18.

Figure 14:
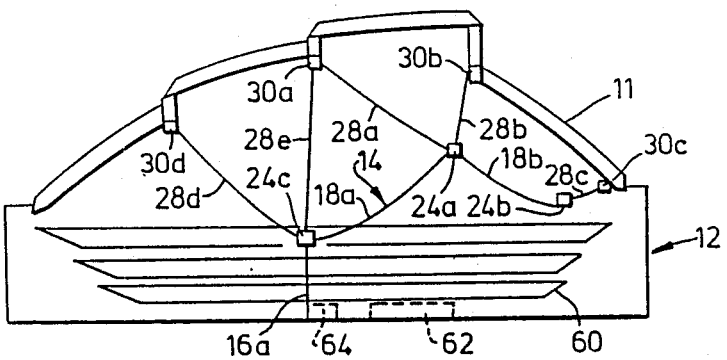

Successive stages in the erection of enclosure 10 are shown in FIGS. 3 to 7 and 2 inclusive and again in FIGS. 10 to 14, the fully erected enclosure (the final stage) being shown in FIGS. 2 and 14. For clarity, girders of roof 11 of stadium 12 are indicated by chain dotted lines 52. The first stage (FIGS. 3 and 10) shows the setup of elements to initiate the erection, in which rows of containers 38*a* and 38*b* are wheeled into position beneath a first row 24*a* of box trusses 24 which are bolted together at their ends, the row being suspended by cables 28*a* passing through sheaves 32*a* from a first winch station 30*a*. Box 24*a* is also connected by cables 28*b* to a second winch station 30*b*. Leading ends 19 of panels 18*a* and 18*b* in containers 38*a* and 38*b* are attached to box truss 24*a* which is then hoisted by cables 28*a* to the position shown in FIGS. 4 and 11. In the second stage (FIGS. 4 and 11) a second box truss 24*b* is connected to the lower end of suspended panels 18*b* of canopy 14*b* and box truss 24*b* is connected by cables 28*c* to a third winch station 30*c*. Box truss 24*b* is then lifted by cables 28*a*, with box truss 24*a*, to the position shown in FIGS. 5 and 12. In the third stage (FIGS. 5 and 12) a third box truss 24*c* is connected by cables 28*d* to a fourth winch station 30*d* and also to winch station 30*a* by cables 28*e*. Also in the third stage panels 16*a* from containers 38 are attached at one end to box truss 24*c*. In the next stage (FIGS. 6 and 13) box truss 24*c* is raised by cables 28*e* while box truss 24*a* is moved laterally by cables 28*b* and box truss 24*b* is moved laterally by cables 28*c*. At a suitable stage in the erection of the enclosure side panels 20 are attached to the outermost panels 18 of canopy 14, for example by hooks and eyes, the most convenient stage being when the panels are emerging from containers 38. In the next stage (FIGS. 7 and 14) canopy 14 is fully extended and side panels are attached to winch stations 36 which draw the panels up over the seats of the stadium to complete the enclosure as the final state (FIG. 2).

At each suitable stage in the erection of the enclosure side curtains 16 are attached to the edges of canopy 14 as by hooks and eyes.

To dismantle the enclosure the above sequence of steps is reversed.

Examples of the fabric which may be used in canopy 14 and side curtains 16 are (1) FABRASORB which is a trade mark of Chemical Fabrics Corporation used in association with an acoustically absorbent fabric of fiberglass coated with TEFLON (a trade mark of a fluorocarbon polymer) and rolled in tension, or (2) DACRON which is a trade mark of a polyester synthetic fibre sold by DuPont Canada Inc. which may be folded or rolled.

Of course canopy 14 may be raised or lowered to achieve any desired height and configuration; for instance FIGS. 2 and 14 show a setup suitable for a concert whereas box truss 24*a* may be raised further to provide an audience chamber suitable for a tennis tournament or a boxing match.

It will be appreciated that the seating extends in an oval configuration around the interior of stadium 12, close-off curtain 16 is intended to bisect the oval on its shorter axis, which means that canopy 10, which is basically rectangular, will cover the seats at one end of the stadium but not the side seats. Side panels 20 form part of canopy 10 to cover the side seats and the lower edge of side panel 20*a* (when attached) would be shaped to the contour of the tiers of seats below it, as seen in Figure 2. When the whole of stadium 12 is being used as an audience chamber the free edges of side panels 20 (when attached) would follow the oval contour of the side wall of the stadium above the seats.

Figure 15:
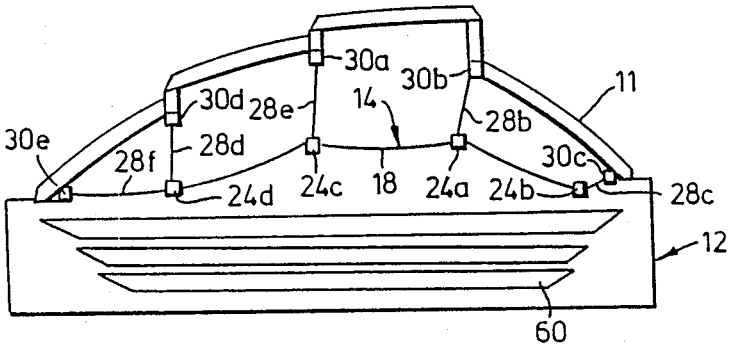
FIG. 15 is a schematic view similar to FIGS. 10 to 14 showing the canopy covering the whole stadium interior.

For clarity only FIGS. 14 and 15 show schematically a typical arrangement of seats 60. When using close-off curtain 16 to form an enclosed audience chamber, additional seats and/or a tennis court or boxing ring 62 may be added on the field of stadium 12; for a concert, only seats would be added together with a stage 64.

If desired to increase the rigidity of canopy 10, panels 18 could be inflatable.

Where the full stadium is to be used as an audience chamber, as seen in FIG. 15, an additional truss 24*d* and additional cables 28*f* would be used together with an additional winch station 30*e*.

We claim:

1. To form an audience chamber within a stadium closed by a roof, at least one truss suspendible from the roof, and a canopy comprising a plurality of parallel, contiguous elongated panels of flexible material each being removably connectable to the truss.

2. A canopy as claimed in claim 1 in which the flexible material is is a polyester synthetic fibre.

3. A canopy as claimed in claim 1 in which the flexible material is is fiberglass coated with a fluorcarbon polymer.

4. A canopy as claimed in claim 3 in which the means to extend and retract the cables comprises winch means having a plurality of sheaves one for each cable, a plurality of the cables being attachable to the truss and the cable being connected each through one of the sheaves to the winch means.

5. A canopy as claimed in claim 4 in which the winch means comprises a plurality of winches mounted in preselected locations on the underside of the roof, the winches being associated one with the truss.

6. A canopy as claimed in claim 1 including a plurality of cables for suspending the truss, and means mounted on the underside of the roof to extend and retract the cables whereby the canopy when connected to the truss is positioned at a selectable height.

7. A canopy as claimed in claim 1 including a plurality of containers each capable of containing one of the panels in rolled form for unrolling to erect the canopy.

8. A canopy as claimed in claim 1 including a plurality of side panels removably attachable to the outermost of the panels of the canopy and extendable to cover laterally disposed seats in the stadium.

9. A canopy as claimed in claim 6 including a plurality of said trusses suspendable from the cables in parallel, spaced relationship, the panels each being removably connectable at their ends to the trusses.

10. A canopy as claimed in claim 9 including a close-off curtain dependable from the canopy.

11. A canopy as claimed in claim 10 in which the close-off curtain comprises a plurality of elongated panels each being connectable at one end to one of the trusses.

12. In a stadium closed by a roof, a canopy forming an audience chamber and comprising:

a plurality of winch stations mounted on the underside of the roof and each having a plurality of cables suspended therefrom;

a plurality o parallel spaced elongated trusses attached one to each plurality of cables, and a plurality of parallel elongated panels of flexible material each being attached at its ends to adjacent pairs of the trusses.

13. A canopy as claimed in claim 12 in which the panels are of fabric material.

14. A canopy as claimed in claim 12 including a cut-off curtain depending from one of the outermost of the trusses.

15. A method of erecting a canopy in a stadium closed by a roof, comprising the steps of:

attaching a first truss to a plurality of winched cables;

attaching the first ends of a plurality of first elongated panels of flexible material in parallel to the first truss and attaching the first ends of a plurality of second elongated panels in parallel to the first truss and then raising the first truss by winching the cables;

attaching a second truss to the second ends of the first panels and raising the second truss by winching the cables;

attaching a third truss to the second ends of the second panels;

attaching a cut-off curtain to the third truss;

raising the third truss and at the same time moving the first and second trusses laterally, all by winching the cables.

16. A method as claimed in claim 15 including the step of attaching side panels to the outermost of the first and second panels and the cut-off curtain.

17. A method as claimed in claim 15 in which the cut-off curtain is replaced by a plurality of third elongated panels connected also to a fourth truss, and raising the fourth truss upwardly and laterally by winching.

* * * * *